United States Patent [19]

Hierons

[11] Patent Number: 4,830,176

[45] Date of Patent: May 16, 1989

[54] CONVEYING ROD-LIKE ARTICLES

[75] Inventor: Kerry Hierons, Bucks, United Kingdom

[73] Assignee: Molins Machine Co., Inc.

[21] Appl. No.: 934,553

[22] Filed: Nov. 24, 1986

[30] Foreign Application Priority Data

Nov. 22, 1985 [GB] United Kingdom ..... 8528842

[51] Int. Cl.[4] ..... B65G 43/08

[52] U.S. Cl. ..... 198/502.2; 198/572; 198/810; 364/562; 364/603; 364/605

[58] Field of Search ..... 198/347, 502.1, 502.2, 198/524, 572, 573, 855, 857, 810; 131/909; 73/861.77, 313, 317; 364/559, 562, 563, 564, 603–605, 817, 819; 222/55

[56] References Cited

U.S. PATENT DOCUMENTS

| | | | |
|---|---|---|---|
| 2,985,277 | 5/1961 | Prellwitz | 198/502.2 |
| 3,064,357 | 11/1962 | Butters | 198/502.2 |
| 4,200,181 | 4/1980 | Clarke | 198/572 |
| 4,344,520 | 8/1982 | Czoch et al. | 198/347 |
| 4,349,096 | 9/1982 | Thamerus | 198/347 |
| 4,359,152 | 11/1982 | Czoch et al. | 198/572 |
| 4,386,406 | 5/1983 | Igarashi et al. | 73/313 |

FOREIGN PATENT DOCUMENTS

| | | | |
|---|---|---|---|
| 136827 | 4/1985 | European Pat. Off. | 198/347 |
| 2157252 | 10/1985 | United Kingdom | 198/347 |

*Primary Examiner*—Joseph E. Valenza

*Attorney, Agent, or Firm*—Antonelli, Terry & Wands

[57] ABSTRACT

A microprocessor is used to control at least one conveyor in a system linking a delivery device (e.g. a cigarette maker) and a receiving device (e.g. a cigarette packer). The conveyor may be controlled in accordance with the calculated deviation in a detected value (e.g. corresponding to stack height) from a target value. Where an analogue signal is produced by the detector device this is converted to digital form and is preferably operated on by a program function so that a linear digital representation or signal relating to the detected value may be produced. For example, the angular displacement of a pivoted sensor arm is used to provide a direct indication of stack height by use of cosine look-up tables held in memory.

4 Claims, 7 Drawing Sheets

CONVEYING ROD-LIKE ARTICLES

This invention relates to conveying rod-like articles, particularly articles of the tobacco industry such as cigarettes or filter rods.

U.K. Pat. Specification No. 2157252A relates to a conveyor system for such articles, including a path extending between a delivery device (e.g. a cigarette making machine) and a receiving device (e.g. a cigarette packing machine) having at least one junction at which articles may be transferred between the path and a subsidiary path, and means for controlling transfer of articles between the path and the subsidiary path. The present invention is particularly, but not exclusively, concerned with or applicable to a similar system. Reference is directed to said specification, the disclosure of which is hereby incorporated herein in its entirety.

According to one aspect of the invention a conveyor system for rod-like articles comprises at least one conveyor for rod-like articles in multi-layer stack formation, drive means for said conveyor, sensor means for detecting at least one parameter associated with said conveyor, and control means including a programmable processor, first input means for transmitting a signal derived from said sensor means, second input means for transmitting a signal which corresponds to a desired value of said parameter, and output means for generating a signal for control of said drive means, said processor being programmed to perform an operation on data corresponding to said input signals such that said output signal causes said drive means to be operated at a rate at which said parameter approaches said desired value. A microprocessor may be used to control at least one conveyor in a system for conveying rod-like articles between a delivery device and a receiving device. Thus the processing means may comprise a microprocessor programmed to perform at least one operation on input data including a presettable constant (which may be a constant or normally non-varying system parameter, or a target value) and at least one system variable (e.g. a measured value, such as stack height, corresponding to article flow rate).

The conveyor may move articles directly or in a container (e.g. a tray). The system may be similar to that disclosed in said specification and include a making machine, packing machine, a tray filling machine, and tray unloading machine. The processing means may control several conveyors according to different measured system variables and different operations (algorithms) may be performed in respect of different conveyors.

A digital signal corresponding to a measured quantity of articles may be generated, and may be used as variable input data in a control processing means such as a microprocessor. The signal, which may be itself generated by a or the microprocessor, may be obtained by performing a series of operations on a signal produced by a level or rate transducer. Where the transducer is an analogue device (e.g. a pivoted sensor arm) the signal is initially converted into digital form. Subsequent operations are preferably such that a linear output signal, e.g. corresponding directly to stack height may be generated. Where the signal corresponds to level of articles on a moving conveyor (which may preferably be under control of the same microprocessor as the level transducer), the measured level and the conveyor speed may be integrated. By further operation in a microprocessor an indication of flow rate may be achieved. For example, the number of articles per second or the total number of articles in a predetermined period may be calculated by the operation.

In a preferred arrangement where the analogue signal corresponds to angular displacement of a sensor arm the operation includes extraction of a relevant cosine (or other appropriate trigonometric function) from a table in memory and calculation according to an algorithm containing relevant constants (e.g. distances or lengths) to generate the linear level value. Thus, for example a stack height signal may be generated (and/or displayed) in convenient dimensions, e.g. millimeters.

The invention will be further described, by way of example only, with reference to the accompanying schematic drawings, in which.

Figure 1:
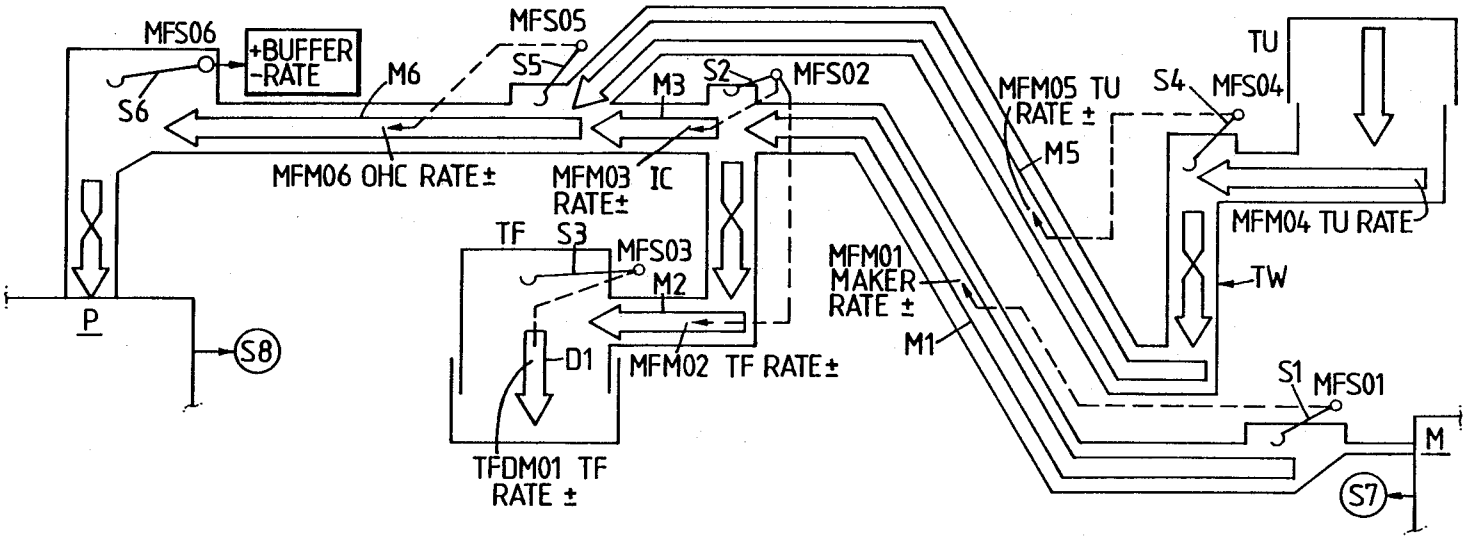
FIG. 1 is a diagrammatic side view of a conveyor system for cigarettes.

The system shown in FIG. 1 is basically similar to that described and illustrated in said U.K. patent specification No. 2157252A. Cigarettes are conveyed in mass flow stack formation from the vicinity of a cigarette making machine M to a packing machine P. Cigarettes are also conveyed from a tray unloader TU and to a tray filler TF. Differences from the system of said specification are that the tray unloader is turned through 90 degrees, so that a twisted downdrop TW is contained in the path leading from the tray unloader TU, and the intermediate conveyor IC is separately driven by its own motor.

Sensors for determining levels of cigarettes at various positions in the system are arranged to control motors for the conveyors as follows:

S1: at a stackformer adjacent the maker M, and controls the main elevator conveyor M1;

S2: above the junction leading to the tray filler TF, and controls the tray filler conveyor M2 and the intermediate conveyor M3;

S3: in the filling head of the tray filler TF and controls the tray filler descent conveyor (i.e. the tray filling rate) D1;

S4: above the twisted downdrop TW adjacent the tray unloader TU, and controls the tray unloader elevator M5;

S5: at the junction between the conveyor from the tray unloader TU and the main cigarette path, and controls the overhead conveyor M6;

S6: above the packer buffer reservoir, and generates a buffer rate signal.

Further sensors S7 and S8 respectively respond to the speeds of the making machine M and the packing machine P. The sensors S7, S8 may comprise tachogenerators.

All of the sensors produce an analogue signal (e.g. angle of displacement of an arm, typically measured by angular rotation of a rotary regulator located at the axis of pivoting of the respective arm and as disclosed in U.K. patent specification No. 1299174 for example, in the case of sensors S1–S6) which is converted to a digital signal. Each of the level sensors S1–S6 has a nominal position corresponding to a target height for cigarettes and deviation from that height generates error signals.

The ranges of the stream height signals at the sensors S1–S6 are MFS01, MFS02, MFS03, MFS04, MFS05, and MFS06, respectively. Each signal in digital form is in the range 0–255 and the error height signal for each is in the range 0 to +/−128. The maker and packer rates, respectively MFS07 and MFS08, are each in the range 0–1000.

Figure 2:
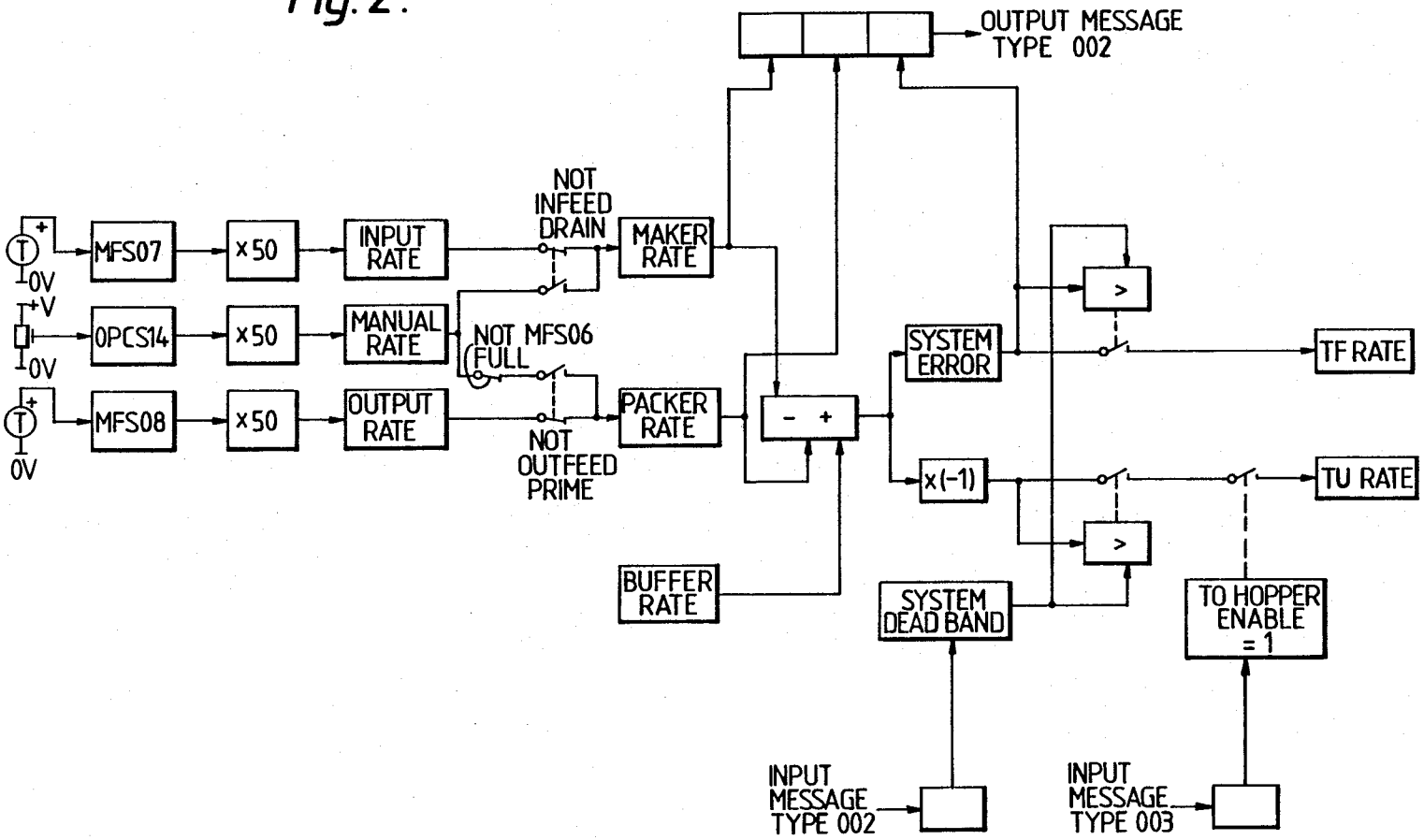
FIGS. 2–8 are flow charts indicating control of conveyors of the system of FIG. 1.
Figure 3:
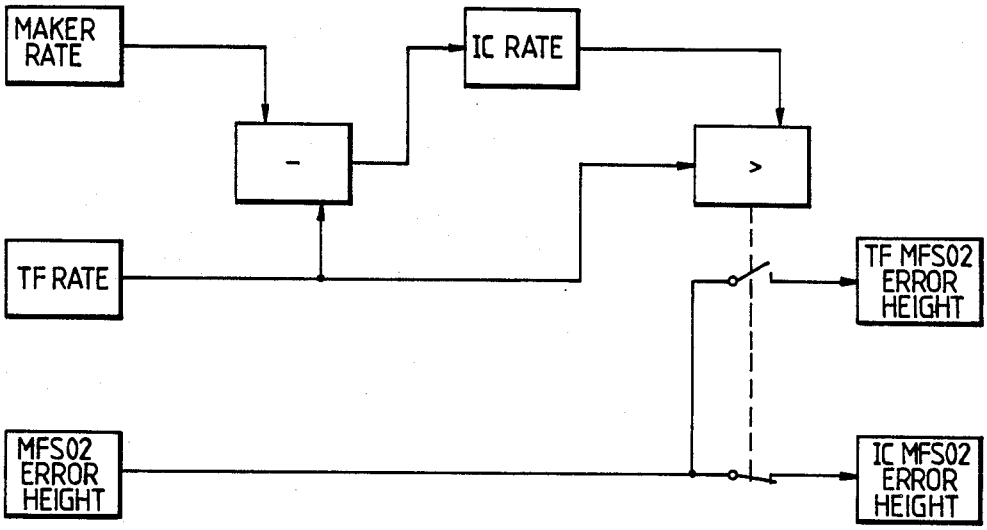
Figure 4:
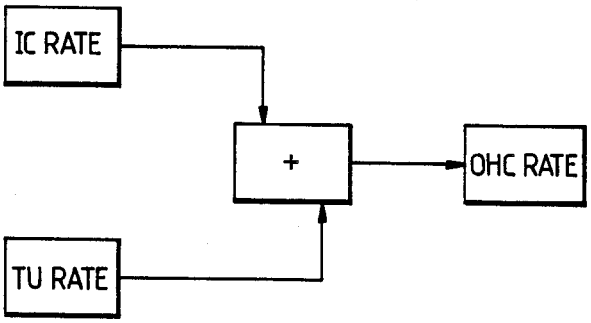

The rates at which the tray filler TF and tray unloader TU are required to operate is generated by a module (e.g. ROM of a microprocessor) having a functional operation as indicated in FIGS. 2–4.

This module contains all of the logical and algebraic functions required to generate the primary rate for each individual massflow conveyor. They are as follows:

MAKER RATE=Maker tacho, MFS07×50

PACKER RATE=Packer tacho, MFS08×50

MANUAL RATE=Manual speed pot, OPCS14×50

BUFFER RATE=MFS06 ERROR HEIGHT×K. BUFFER.2 (Proportional) or

BUFFER GULP RATE (Level switched) selected by the BUFFER CONTROL SWITCH.

+SYSTEM ERROR RATE=MAKER RATE−PACKER RATE+BUFFER RATE.

−SYSTEM ERROR RATE=+SYSTEM ERROR RATE×(−1).

If +SYSTEM ERROR RATE>SYSTEM DEAD-BAND (1000 CPM) then TRAY FILLER RATE=+SYSTEM ERROR RATE. If not TRAY FILLER RATE=0.

INTERMEDIATE RATE=MAKER RATE−TRAY FILLER RATE.

If −SYSTEM ERROR RATE>SYSTEM DEAD BAND (1000 CPM) then TRAY UNLOADER RATE=−SYSTEM ERROR RATE. If not TRAY UNLOADER RATE=0.

OVER-HEAD RATE=INTERMEDIATE RATE+TRAY UNLOADER RATE.

If TRAY FILLER RATE>INTERMEDIATE RATE then TF MFS02 ERROR HEIGHT=MFS02 ERROR HEIGHT. If not then TF MFS02 ERROR HEIGHT=0.

If INTERMEDIATE RATE>OR=TRAY FILLER RATE then IC MFS02 ERROR HEIGHT=MFS02 ERROR HEIGHT. If not then IC MFS02 ERROR HEIGHT=0.

The "manual rate" is not used in normal operation but allows non-automatic operation (e.g. for priming or for draining, i.e. reversing of elevators to empty the system).

The "buffer gulp rate" and generation of the "buffer rate" are explained below with reference to FIG. 5.

The "system dead band" is a predetermined speed (e.g. 1000 c.p.m.) which is required to be exceeded (in a positive or negative sense) by the system error rate (as defined) before the tray filler or tray unloader will operate.

The "intermediate rate" and the "overhead rate" are respectively the rates of the intermediate conveyor (M3) and the overhead conveyor (M6).

A "type 2" input or output message is an initialisation message which contains information on system data constants. A type 2 message can be generated only after a type 1 initialisation/checking message has been generated and satisfactorily received: the main microcomputer module performs this function automatically. A "type 3" message contains information on system variables, i.e. measured values.

In FIG. 2 the input message (type 2) is the value of the system dead band (i.e. 1000 cpm) and the output messages are maker rate, packer rate and system error rate.

Figure 5:
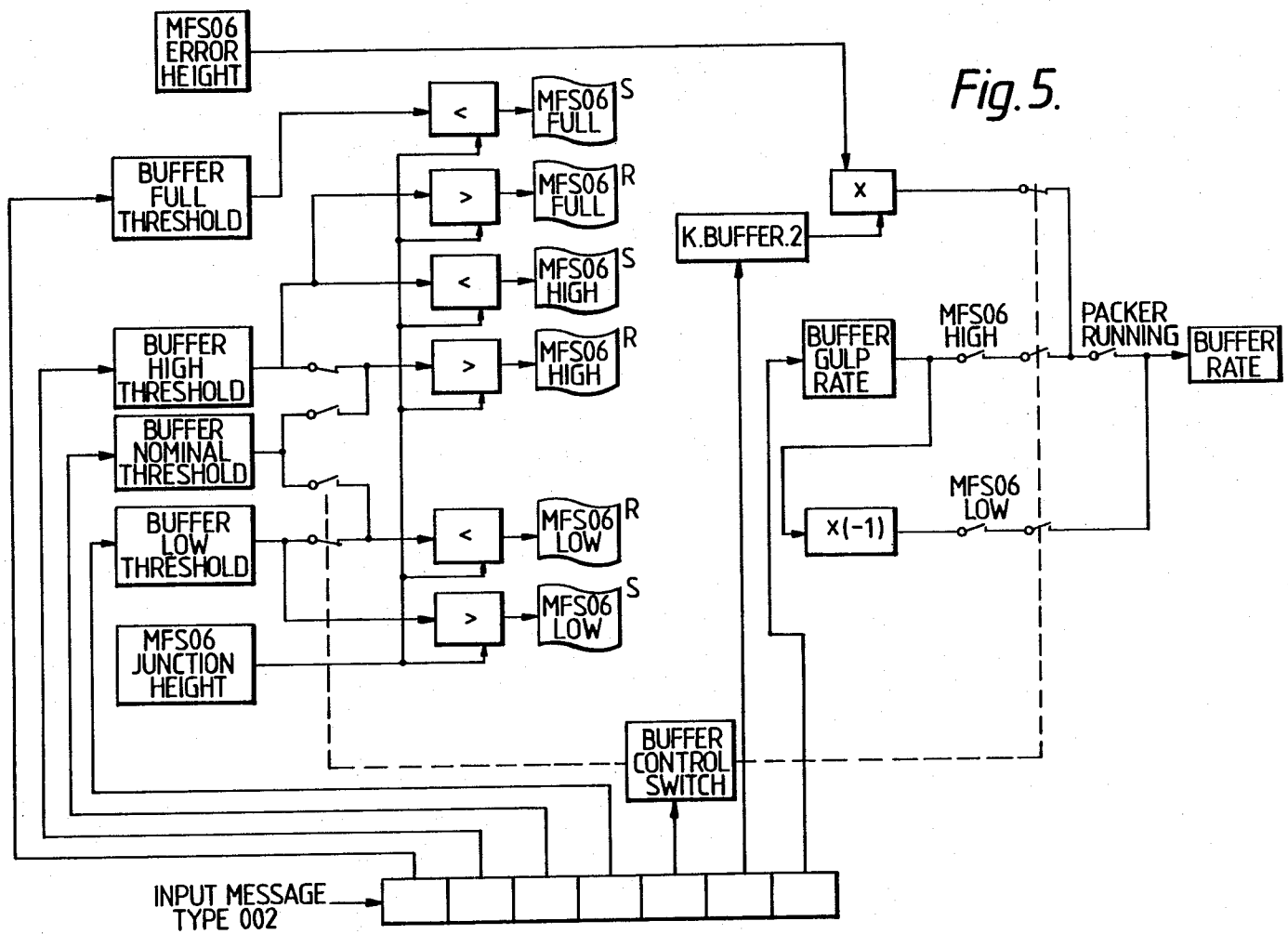

The generation of the buffer rate is shown in FIG. 5. Normally the rate is variable and determined by the error height measured by sensor S6. Alternatively, by operation of a buffer control switch, the buffer rate to be applied to the system error rate algorithm may be a predetermined positive or negative value: this is referred to as the "buffer gulp rate".

Figure 6:
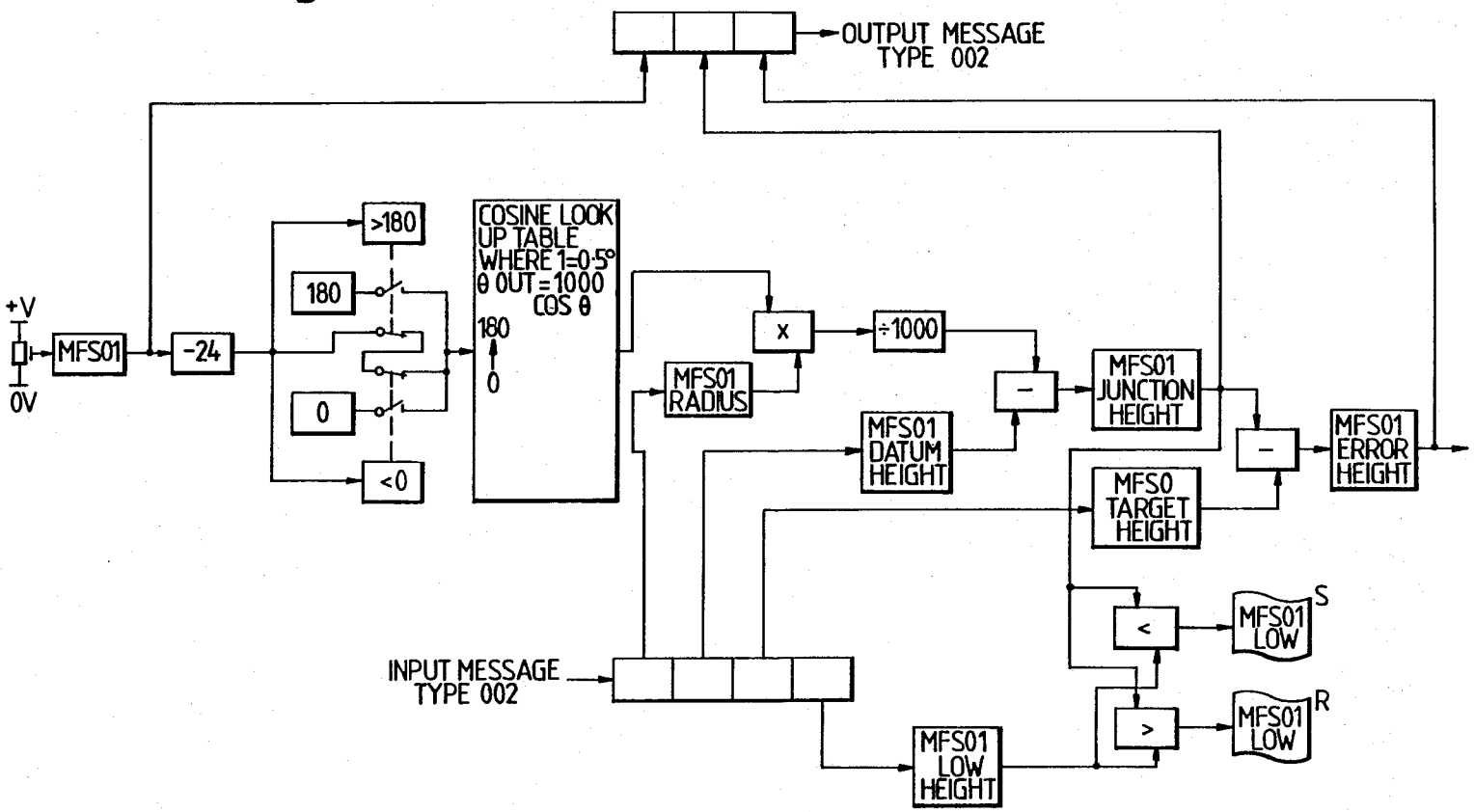

The junction height signals are generated by modules having functional operations similar to that shown in FIG. 6, which represents the module for the sensor S1. The error height signal is generated by converting an analogue signal indicative of an angular position into a digital signal, as follows.

All level sensors have maximum angular movement of 115 degrees. This angle generates an analogue to digital input number from 0 to 250. This number is then split into three segments.

Sensor over-range—from 205 to 250=90.5 to 103.0 degrees.

Sensor dynamic range—from 024 to 204=0.0 to 90.0 degrees.

Sensor under-range—from 000 to 023=−12.0 to −8.5 degrees.

The master processor checks for the over or under-range sensor condition and will declare an emergency stop if either occurs.

The following equation is applied to each set of junction parameters to determine its linear vertical height in millimeters.

$$\text{JUNCTION HEIGHT } JH = DH - SR \times \cos(SA - 24).$$

Where:

DH=DATUM HEIGHT, from the conveyor band to the sensor centre line.

SR=SENSOR RADIUS.

COS=COSINE LOOK UP TABLE.

SA=SENSOR ANGLE (LOOK UP TABLE POINTER).

−24=SENSOR UNDER-RANGE SEGMENT.

Having obtained the junction height then the error height $$EH = JH - TH.$$

Where:

EH=ERROR HEIGHT.

JH=JUNCTION HEIGHT.

TH=TARGET HEIGHT.

There are six junction error heights.

Stackformer junction=MFS01 ERROR HEIGHT.

Tray filler junction=MFS02 ERROR HEIGHT.

Tray filler hopper=MFS03 ERROR HEIGHT.

Tray unloader spiral junction=MFS04 ERROR HEIGHT.

Tray unloader junction=MFS05 ERROR HEIGHT.

Packer buffer junction=MFS06 ERROR HEIGHT.

Thus, the angle at which the sensor arm is disposed, generates a variable signal which is used to extract the appropriate cosine value from a look-up table held in memory. This is operated on algebraically in accordance with the above junction height equation, the datum height and the sensor arm radius (length) having been supplied as input messages. The target height (i.e. required stack level) and minimum stack height (i.e. S1 low) are also set by inputs. Output messages corresponding to the sensor angle, junction height and the error height may be generated, as well as a sensor low indication. The algorithm applied is such that the height value generated is the linear stack height (in millimeters).

Sensors S1–S5 are associated with modules substantially identical to that shown in FIG. 6. Sensor S6 is associated with a module which is also similar but does not include the sensor low set/reset provision.

Figure 7:
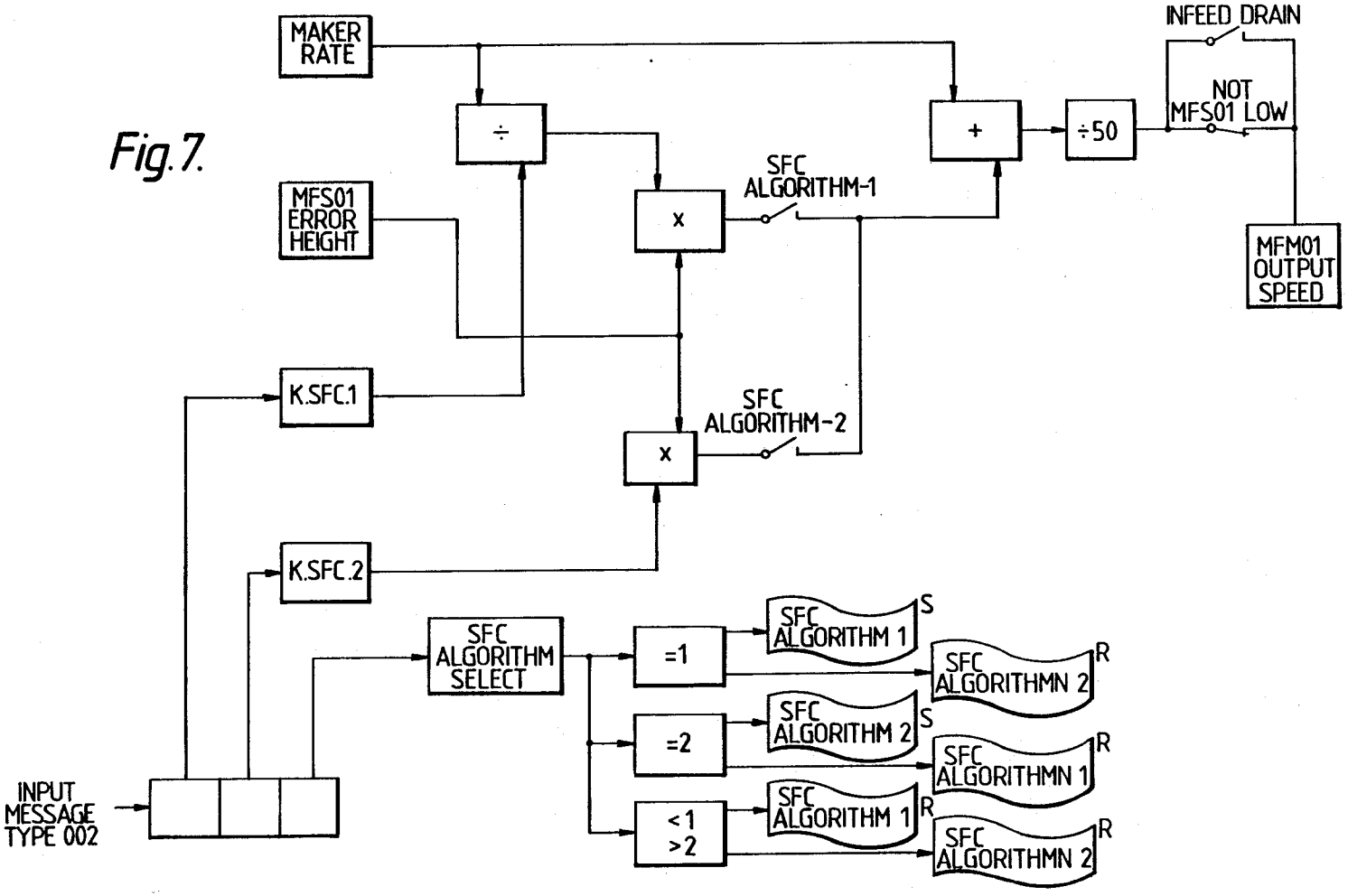

The final conveyor speed is obtained by operation of the following algorithms on the error heights generated by sensors S1–S5. FIG. 7 shows the flow chart for the sensor S1.

One of two algorithms is applied to each set of conveyor parameters to determine the final conveyor speed. The algorithm select logic via the V.D.U. is arranged so that an individual conveyor can be assigned to run either algorithm independently of the other conveyors.

ALGORITHM 1 for the stackformer conveyor MFM01=MAKER RATE+(MFS01 ERROR HEIGHT×MAKER RATE/K.SFC.1)

ALGORITHM 2 for the stackformer conveyor MFM01=MAKER RATE+(MFS01 ERROR HEIGHT×K.SFC.2). K.SFC.1 and K.SFC.2 are scaling constants derived from K.SFC.0 where K.SFC.0 is in the range 1 to 2000 and is entered via the V.D.U.

K.SFC.1=1/K.SFC.0×1000=K.SFC.0×0.1% CPM/mm

K.SFC.2=K.SFC.0×10=K.SFC.0×10 CPM/mm

ALGORITHM 1 for the tray filler conveyor MFM02=TF RATE+(TF MFS02 ERROR HEIGHT×TF RATE/K.TFC.1)

ALGORITHM 2 for the tray filler conveyor MFM02=TF RATE+(TF MFS02 ERROR HEIGHT×K.TFC.2).

ALGORITHM 1 for the intermediate conveyor MFM03=IC RATE+(IC MFS02 ERROR HEIGHT×IC RATE/K.IC.1).

ALGORITHM 2 for the intermediate conveyor MFM03=IC RATE+(IC MFS02 ERROR HEIGHT×K.IC.2)

ALGORITHM 1 for the tray unloader hopper conveyor MFM04=TU RATE.

ALGORITHM 1 for the tray unloader elevator conveyor MFM05=TU RATE+(MFS04 ERROR HEIGHT×TU RATE/K.TUEC.1)

ALGORITHM 2 for tray unloader elevator conveyor MFM05=TU RATE+(MFS04 ERROR HEIGHT×K.TUEC.2)

ALGORITHM 1 for the over-head conveyor MFM06=OH RATE+(MFS05 ERROR HEIGHT×OH RATE/K.OHC.1)

ALGORITHM 2 for the over-head conveyor MFM06=OH RATE+(MFS05 ERROR HEIGHT×K.OHC.2)

ALGORITHM 1 for the tray filler descent TFDM01=TF RATE+(MFS03 ERROR HEIGHT×TF RATE/K.TFD.1)

ALGORITHM 2 for the tray filler descent TFDM06=TF RATE+(MFS03 ERROR HEIGHT×K.TFD.2)

Figure 8:
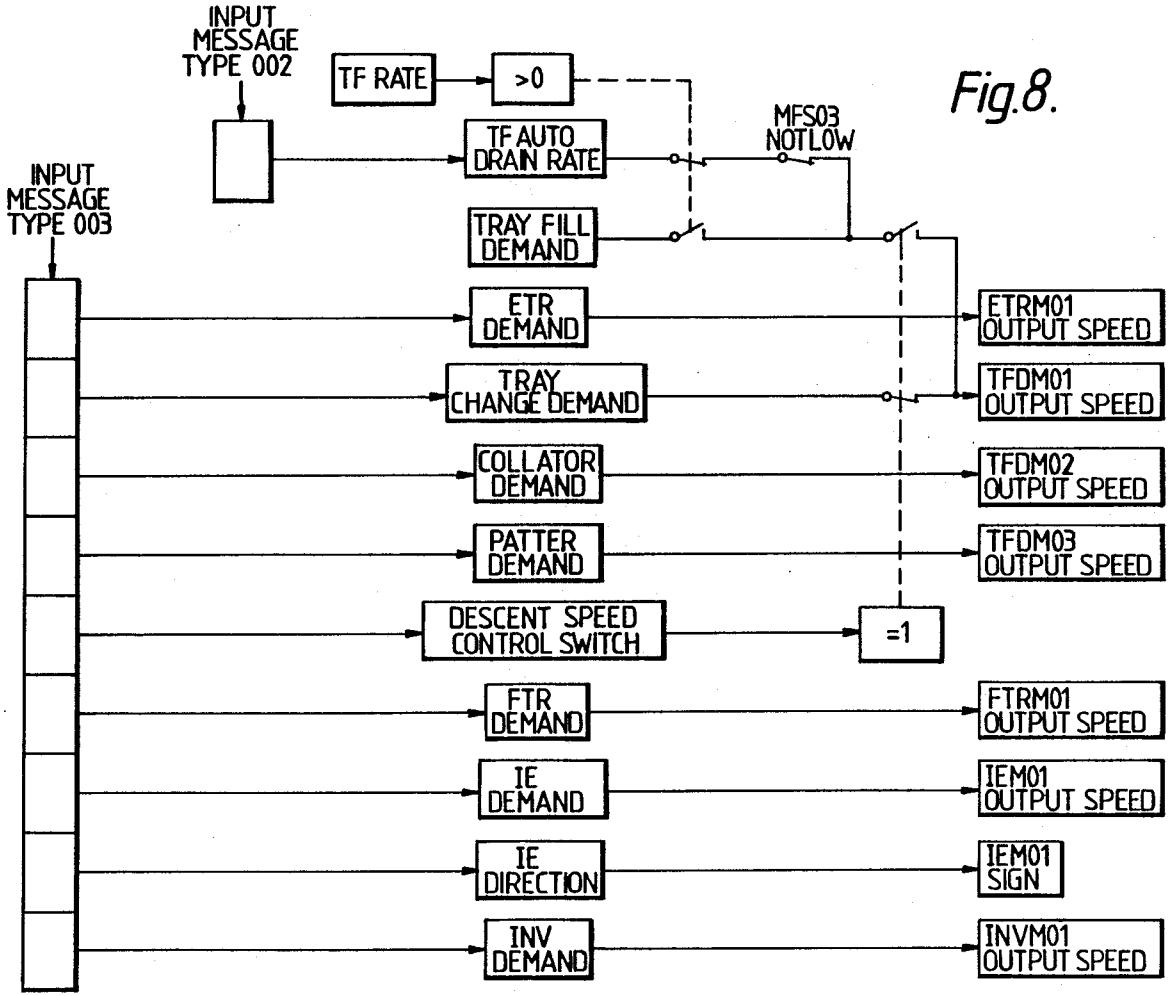

The microprocessor containing the modules controlling the conveyor system as described above is also capable of controlling other motors within the equipment of which the system forms a part. Thus, as indicated in FIG. 8, motors for empty tray reservoir, tray filler descent (3), full tray reservoir, inverter elevator (for tray unloader), and tray inverter (of tray unloader), may be controlled.

Typical values for the system constant inputs and suitable default values and ranges for variables are set out in below.

| LABEL | DEFAULT | RANGE | UNITS |
|---|---|---|---|
| SYSTEM DEAD BAND = | 1000 CPM | 50 TO 5000 | 50 |
| MFS01 RADIUS = | 139 mm | 1 TO 200 | 1 |
| MFS01 DATUM HEIGHT = | 173 mm | 1 TO 200 | 1 |
| MFS01 TARGET HEIGHT = | 090 mm | 1 TO 200 | 1 |
| MFS01 LOW HEIGHT = | 070 mm | 1 TO 200 | 1 |
| MFS02 RADIUS = | 128 mm | 1 TO 200 | 1 |
| MFS02 DATUM HEIGHT = | 170 mm | 1 TO 200 | 1 |
| MFS02 TARGET HEIGHT = | 110 mm | 1 TO 200 | 1 |
| MFS02 LOW HEIGHT = | 080 mm | 1 TO 200 | 1 |
| MFS03 RADIUS = | 330 mm | 1 TO 400 | 1 |
| MFS03 DATUM HEIGHT = | 195 mm | 1 TO 400 | 1 |
| MFS03 TARGET HEIGHT = | 100 mm | 1 TO 400 | 1 |
| MFS03 LOW HEIGHT = | 085 mm | 1 TO 400 | 1 |
| MFS04 RADIUS = | 185 mm | 1 TO 300 | 1 |
| MFS04 DATUM HEIGHT = | 240 mm | 1 TO 300 | 1 |
| MFS04 TARGET HEIGHT = | 090 mm | 1 TO 300 | 1 |
| MFS04 LOW HEIGHT = | 060 mm | 1 TO 300 | 1 |
| MFS05 RADIUS = | 181 mm | 1 TO 300 | 1 |
| MFS05 DATUM HEIGHT = | 230 mm | 1 TO 300 | 1 |
| MFS05 TARGET HEIGHT = | 090 mm | 1 TO 300 | 1 |
| MFS05 LOW HEIGHT = | 060 mm | 1 TO 300 | 1 |
| MFS06 RADIUS = | 500 mm | 1 TO 600 | 1 |
| MFS06 DATUM HEIGHT = | 250 mm | 1 TO 600 | 1 |
| MFS06 FULL HEIGHT = | 240 mm | 1 TO 600 | 1 |
| MFS06 HIGH HEIGHT = | 230 mm | 1 TO 600 | 1 |
| MFS06 NOMINAL HEIGHT = | 210 mm | 1 TO 600 | 1 |
| MFS06 LOW HEIGHT = | 190 mm | 1 TO 600 | 1 |
| BUFFER CONTROL SWITCH = | 1 | 1 TO 2 | 1 |
| K.BUFFER.2 = | 250 | 1 TO 2000 | 10 |
| BUFFER GULP RATE = | 2500 CPM | 50 TO 5000 | 50 |
| K.SFC.1 = | 040 | 1 TO 200 | 1 |
| K.SFC.2 = | 250 | 10 TO 2000 | 10 |
| SFC ALGORITHM SELECT = | 1 | 1 TO 2 | 1 |
| K.TFC.1 = | 040 | 1 TO 200 | 1 |
| K.TFC.2 = | 250 | 10 TO 2000 | 10 |
| TFC ALGORITHM SELECT = | 1 | 1 TO 2 | 1 |
| K.IC.1 = | 040 | 1 TO 200 | 1 |
| K.IC.2 = | 250 | 10 TO 2000 | 10 |
| IC ALGORITHM SELECT = | 1 | 1 TO 2 | 1 |
| K.TUEC.1 = | 040 | 1 TO 200 | 1 |
| K.TUEC.2 = | 250 | 10 TO 2000 | 10 |
| TUEC ALGORITHM SELECT = | 1 | 1 TO 2 | 1 |
| K.OHC.1 = | 040 | 1 TO 200 | 1 |
| K.OHC.2 = | 250 | 10 TO 2000 | 10 |
| OHC ALGORITHM SELECT = | 1 | 1 TO 2 | 1 |
| K.TFD.1 = | 040 | 1 TO 200 | 1 |
| K.TFD.2 = | 250 | 10 TO 2000 | 10 |
| TFD. ALGORITHM SELECT = | 1 | 1 TO 2 | 1 |

-continued

| LABEL | DEFAULT | RANGE | UNITS |
|---|---|---|---|
| TF AUTO DRAIN RATE = | 5000 CPM | 50 TO 10000 | 50 |

I claim:

1. A conveyor system for rod-like articles comprising at least one conveyor for rod-like articles in multi-layer stack formation; drive means for said conveyor; sensor means for detecting at least one parameter associated with said conveyor and for producing a flow rate signal; and control means including a programmable processor, first input means for transmitting said flow rate signal derived from said sensor means, second input means for transmitting a signal which corresponds to a desired value of flow rate for said one conveyor, and output means for generating a signal for control of said drive means; said processor being programmed to perform an operation on data corresponding to said input signals such that said output signl causes said drive means to be operated at a rate at which said sensed flow rate approaches said desired value; wherein said sensor means comprises means for generating a signal indicative of speed of said conveyor, a level detector having an angularly displaceable member for responding to the height of a stream of rod-like articles and producing a signal representing the varying height of articles on said conveyor in terms of the angular displacement of said member, said processor being programmed to perform an operation to convert a value representative of said angular displacement to a value directly relating to said height, and means for integrating said conveyor speed signal and said height signal to generate a flow rate signal.

2. A conveyor system as claimed in claim 1, wherein said first input means comprises transducer means for generating an analogue signal and includes an analogue to digital converter.

3. A conveyor system as claimed in claim 2, wherein at least one of said first and second sensor means comprises means for producing a signal which varies with angular displacement of a member.

4. A conveyor system as claimed in claim 1, wherein said processor means is programmed so that said operation includes accessing a table of trigonometric values held in memory to enable said conversion to be made.

* * * * *